US007134388B2

(12) United States Patent
Suzuki et al.

(10) Patent No.: US 7,134,388 B2
(45) Date of Patent: Nov. 14, 2006

(54) CALENDER FOR A SHEET OF PAPER

(75) Inventors: Setsuo Suzuki, Hiroshima-ken (JP); Takeshi Matsuo, Hiroshima-ken (JP); Junichi Ibushi, Hiroshima-ken (JP); Hatsuo Mori, Hiroshima-ken (JP); Fujio Shinoki, Hiroshima-ken (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 10/944,747

(22) Filed: Sep. 21, 2004

(65) Prior Publication Data

US 2005/0056164 A1 Mar. 17, 2005

Related U.S. Application Data

(62) Division of application No. 10/291,800, filed on Nov. 12, 2002, now Pat. No. 6,837,157.

(30) Foreign Application Priority Data

Nov. 12, 2001 (JP) ..... 2001-345878
Sep. 30, 2002 (JP) ..... 2002-285832

(51) Int. Cl.
*B30B 5/04* (2006.01)
*D06C 15/02* (2006.01)

(52) U.S. Cl. ..... 100/155 R; 100/47; 100/153; 100/176; 162/358.3; 162/361; 492/7; 492/16

(58) Field of Classification Search ..... 100/47, 100/118, 153, 155 R, 161, 162 R, 162 B, 100/163 R, 169, 170, 172, 176, 174; 162/205, 162/272, 281, 361, 358.3; 492/6, 7, 16, 18, 492/20

See application file for complete search history.

(56) References Cited

U.S. PATENT DOCUMENTS

| | | | | |
|---|---|---|---|---|
| 4,518,460 A | | 5/1985 | Hauser et al. | 162/361 |
| 4,555,305 A | | 11/1985 | Steiner et al. | 162/205 |
| 4,673,461 A | | 6/1987 | Roerig et al. | 162/205 |
| 5,092,962 A | * | 3/1992 | Koski | 162/358.5 |
| 5,466,343 A | * | 11/1995 | Kankaanpaa | 162/357 |

(Continued)

FOREIGN PATENT DOCUMENTS

DE 33 17 457 A1 11/1984

(Continued)

OTHER PUBLICATIONS

T. Abe, "Surface-treating Apparatus and Surface-treating Method for paper Sheet", Japanese Patent Laid-Open (Kokai) HEI 6-322693 * Abstract.

(Continued)

*Primary Examiner*—Derris H. Banks
*Assistant Examiner*—Jimmy T. Nguyen
(74) *Attorney, Agent, or Firm*—Armstrong, Kratz, Quintos, Hanson & Brooks, LLP

(57) ABSTRACT

A calender for a sheet of paper comprising a metal roll which is rotated by a first driving unit. The calender further comprises a rotatable cylindrical jacket, a pressurizing shoe, and a plurality of support members. The cylindrical jacket is disposed opposite the metal roll to form a calender nip so that the sheet of paper is continuously passed through the calender nip. The pressurizing shoe is provided within the jacket at the position of the calender nip and presses the interior surface of the jacket radially outward to pressurize the calender nip. The support members are disposed inside the jacket so that they are equally balanced in the peripheral direction of the jacket.

9 Claims, 15 Drawing Sheets

U.S. PATENT DOCUMENTS

| | | | | |
|---|---|---|---|---|
| 5,791,245 | A | 8/1998 | Schnyder et al. | 101/153 |
| 6,158,333 | A | 12/2000 | Honkalampi et al. | 100/38 |
| 6,164,198 | A | 12/2000 | Honkalampi et al. | 100/327 |
| 6,228,222 | B1 * | 5/2001 | Meschenmoser et al. | 162/360.3 |

FOREIGN PATENT DOCUMENTS

| | | |
|---|---|---|
| DE | 198 16 235 A1 | 10/1999 |
| DE | 19860735 | 7/2000 |
| JP | 2000-178892 | 6/2000 |
| JP | 2000-178893 | 6/2000 |

OTHER PUBLICATIONS

S. Suzuki, et al., "Calender and Method of Controlling the Calender", Japanese Patent Laid-Open (Kokai) 2002-030591 and English translation.

* cited by examiner

10:METAL ROLL
12:DRIVING MOTOR (FIRST DRIVING MOTOR)
15:PAPER SHEET
100:PRESSURIZING ROLL
101:JACKET
102:STATIONARY BASE
105:PRESSURIZING SHOE
106, 107:SUPPORT SHOE
120:DOCTOR BLADE
130:DRIVING ROLL
150:DRIVING MOTOR (SECOND DRIVING MOTOR)

10:METAL ROLL
12:DRIVING MOTOR (FIRST DRIVING MOTOR)
100:PRESSURIZING ROLL
104, 137:CENTER SHAFT
130:DRIVING ROLL
150:DRIVING MOTOR (SECOND DRIVING MOTOR)
160:ROLL-MOVING UNIT
170:CONTROLLER

10:METAL ROLL
12:DRIVING MOTOR (FIRST DRIVING MOTOR)
100:PRESSURIZING ROLL
104:CENTER SHAFT
120:DOCTOR BLADE
160:ROLL-MOVING UNIT
170:CONTROLLER

100:PRESSURIZING ROLL
130:DRIVING ROLL
135:DIVIDED ROLL
136:CONNECTING SHAFT
150:DRIVING MOTOR (SECOND DRIVING MOTOR)

100:PRESSURIZING ROLL
125:DIVIDED DOCTOR BLADE
126:SUPPORT PLATE

10:METAL ROLL
12:DRIVING MOTOR (FIRST DRIVING MOTOR)
100:PRESSURIZING ROLL
105:PRESSURIZING SHOE
107:SUPPORT SHOE
107a:DIVIDED SUPOORT SHOE
107b:PRESSURIZING UNIT
130:DRIVING ROLL
150:DRIVING MOTOR (SECOND DRIVING MOTOR)

10:METAL ROLL
12:DRIVING MOTOR (FIRST DRIVING MOTOR)
15:PAPER SHEET
100:PRESSURIZING ROLL
101:JACKET
103:STATIONARY BASE
105:PRESSURIZING SHOE
106~109:SUPPORT SHOE
121,122:DOCTOR BLADE
130:DRIVING ROLL
132:ROTATABLE SUPPORT ROLL
140:LUBRICATING-OIL INJECTION NOZZLE
145:LUBRICATING OIL
150:DRIVING MOTOR (SECOND DRIVING MOTOR)

180, 181 : SUPPORT SHOE
182, 183 : GROOVE

10:METAL ROLL
12:DRIVING MOTOR (FIRST DRIVING MOTOR)
15:PAPER SHEET
100:PRESSURIZING ROLL
101:JACKET
105:PRESSURIZING SHOE
106, 108, 109:SUPPORT SHOE
110:SUPPORT ROLL
116:STATIONARY BASE
120:DOCTOR BLADE
130:DRIVING ROLL
140:LUBRICATING-OIL INJECTION NOZZLE
145:LUBRICATING OIL
150:DRIVING MOTOR (SECOND DRIVING MOTOR)

10:METAL ROLL
12:DRIVING MOTOR (FIRST DRIVING MOTOR)
100:PRESSURIZING ROLL
105:PRESSURIZING SHOE
110:SUPPORT ROLL
130:DRIVING ROLL
150:DRIVING MOTOR (SECOND DRIVING MOTOR)

111, 112: SUPPORT ROLL
113, 114: GROOVE

10: METAL ROLL
12: DRIVING MOTOR (FIRST DRIVING MOTOR)
100: PRESSURIZING ROLL
105: PRESSURIZING SHOE
110: SUPPORT ROLL
115: DIVIDED SUPPORT ROLL
130: DRIVING ROLL
150: DRIVING MOTOR (SECOND DRIVING MOTOR)

1:STATIONARY BEAM
2:SLEEVE
3:PRESSURIZING SHOE
4, 5:LUBRICATING-OIL SUPPLY PASSAGE
6, 7:LUBRICATING-OIL COLLECTION PASSAGE
8:GUIDE MEMBER
10:METAL ROLL
15:PAPER SHEET

1:STATIONARY BEAM
2:SLEEVE
3:PRESSURIZING SHOE
4, 5:LUBRICATING-OIL SUPPLY PASSAGE
6:LUBRICATING-OIL COLLECTION PASSAGE
9:CLAMP DISC
11:SUPPORT LEG

10:METAL ROLL
15:PAPER SHEET
18:PRESSURIZING SHOE
20:PRESSURIZING UNIT
30:SHOE ROLL
32:FLEXIBLE JACKET
34:SUPPORT TABLE
95:PRESSURIZING UNIT

10:METAL ROLL
18:PRESSURIZING SHOE
20:PRESSURIZING UNIT
24, 26:END PLATE
30:SHOE ROLL
32:FLEXIBLE JACKET
34:SUPPORT TABLE 24, 26: END PLATE
32: FLEXIBLE JACKET
48: DRIVING SHAFT
56: GEAR

CALENDER FOR A SHEET OF PAPER

This application is a divisional application of Ser. No. 10/291,800, filed Nov. 12, 2002, now U.S. Pat. No. 6,837, 157.

BACKGROUND OF THE. INVENTION (1) Field of the Invention

The present invention relates generally to a calender for a sheet of paper, and more particularly to a calender which performs a surface process on paper after it is dried by a drier, to make it smooth and glossy.

(2) Description of the Related Art

In paper mills, a layer of paper made by a paper-making section is pressed to remove water by a press. Then, the paper is heated and dried. Next, a calender is employed as a machine in which paper is pressed by rollers to glaze or smooth it.

Typical examples of calenders are a chilled nip calender, a soft nip calender, and a shoe calender. The chilled nip calender is equipped with chilled metal rolls to form at least one pair of nips. The soft nip calender is constructed of a metal roll and an elastic resin roll. In the soft nip calender, only a pair of nips is formed on the periphery of the resin roll. The shoe calender is constructed of a metal roll, a tube sleeve disposed opposite the metal roll and a shoe which is inside of the tube sleeve. The shoe is pressed against the inner periphery of the sleeve to form a nip.

Since the present invention relates to the above-described shoe calender, two conventional shoe calenders will hereinafter be described with reference to FIGS. 13 to 17.

FIGS. 13 and 14 show a first conventional shoe calender described in patent reference 1. The conventional shoe calender is constructed of an upper half part including a metal roll 10, and a lower half part including a cylindrical stationary beam 1, a sleeve 2, etc. The cylindrical stationary beam 1 is fixedly attached to a support leg 11. The outer periphery of the stationary beam 1 is provided with guide members 8 at suitable intervals with respect to the center of the stationary beam 1.

A sleeve 12 is provided to cover the cylindrical stationary beam 1 and rotatably supported by the guide members 8. The opposite ends of the sleeve 12 are further supported by clamp discs 9 to make the interior airtight.

In the conventional shoe calender constructed as described above, when a paper sheet 15 is calendered, the lower half part of the calender with the sleeve 2 is brought into contact with the peripheral surface of the metal roll 10 through the paper sheet 15, as shown in FIG. 13. The sleeve 2 is pressurized by applying pressurized oil to the pressurizing shoe 3 and utilizing the deformation of the sleeve 2 that develops when the sleeve 2 is pressed radially outward.

The stationary beam 1 is further provided with lubricating-oil supply passages 4, 5 and lubricating-oil collection passages 6, 7. The first lubricating-oil supply passage 4 is connected to the lower portion of the pressurizing shoe 3 so that pressurizing force is applied to the pressurizing shoe 3. The second lubricating-oil supply passage 5 is opened at the outer periphery of the stationary beam 1 so that lubricating oil can be supplied to the inner periphery of the sleeve 2.

FIGS. 15 through 17 show a second conventional shoe calender described in patent reference 2. The conventional shoe calender is basically the same in construction as the first conventional shoe calender shown in FIGS. 13 and 14.

As in the first conventional shoe calender, a flexible jacket 32 is pressed against a metal roll 10 to calender a paper sheet 15.

That is, to calender the paper sheet 15, a shoe roll 30 is pressed against the metal roll 10 by a pressurizing shoe 18 provided inside the flexible jacket 32. Reference numeral 95 denotes a pressurizing unit for the metal roll 10. Reference numeral 34 denotes a support beam for the pressurizing shoe 18, and 20 denotes a pressurizing unit.

As shown in FIG. 16, the opposite ends of the flexible jacket 32 are fixed to end plates 24, 26. If the pressurizing unit 20 is actuated, the pressurizing shoe 18 projects in the radial direction of the flexible jacket 32 and deforms the flexible jacket 32. As a result, the paper sheet 15 is pressurized between the metal roll 10 and the flexible jacket 32.

In the conventional shoe calender shown in FIGS. 13 and 14, the sleeve 2 is rotated by the rotational force of the metal roll 10 which is rotated by a driving unit (not shown). Because of this, if the pressurizing force of the pressurizing shoe 3 is weak, the transmission of the rotational force will be insufficient, and consequently, the sleeve 2 will slip easily. Conversely, if it is strong, the friction between the pressurizing shoe 3 and the sleeve 2 will increase. As a result, heat will be generated and the sleeve 2 will be elliptically deformed.

Hence, the shoe calender is provided with the lubricating-oil supply passages 5, and lubricating oil is supplied to the inner periphery of the sleeve 2 to prevent generation of heat and perform lubrication. In addition, the guide members 8 are disposed inside the sleeve 2 to prevent deformation of the sleeve 2.

However, if the pressurizing force reaches a predetermined value or greater, deformation of the sleeve 2 will become great and therefore gaps will be produced between the guide member 8 and the sleeve 2. As a result the effect of the guide members 8 will no longer be obtained.

Because of the gaps between the guide members 8 and the sleeve 2, the sleeve 2 is insufficiently supported and therefore vibrates. As a result, there is a problem that because of the vibration, the trace of vibration will occur in the paper sheet 15.

In chilled nip calenders, incidentally, paper is passed between rolls in contact with each other. However, in soft nip calenders, if a rubber roll is contacted with a high-temperature metal roll without paper, the rubber will degrade. Because of this, the rubber roll is held away from the metal roll until paper is passed through. After paper is passed through, the rubber roll is pressed against the metal roll through the paper.

On the other hand, in the conventional shoe calender (patent reference 1), the sleeve 2 is of a driven type. That is, the sleeve 2 is rotated by contacting with the metal roll 10. In this shoe calender, as with chilled nip calenders, paper is passed between the sleeve 2 and the metal roll 10 after the sleeve 2 is contacted with the metal roll 10. Because of this, before paper is passed through, the outer periphery of the sleeve 2 is contacted directly with the high-temperature metal roll 10.

However, since the outer periphery of the sleeve 2 of the shoe calender is constructed of elastic synthetic resin, if the sleeve 2 of the shoe calender is exposed to high temperature for along time and rises in temperature, then the quality will degrade and the life will be shortened. Particularly, in such a shoe calender, the nip passage time is long and therefore the contact area (i.e., contact time) between the outer periphery of the sleeve 2 and the metal roll 10 is long. As a result, the temperature of the outer periphery of the sleeve 2 becomes considerably high.

To prevent the problem of high temperature, it is contemplated that the sleeve 2 is held away from the metal roll 10 until paper is passed through. In soft nip calenders, such a process is often performed. However, since the sleeve 2 in the conventional shoe calender (patent reference 1) has no driving unit, the sleeve 2 will no longer rotate if it is moved away from the metal roll 10. Therefore, in the case where the sleeve 2 is contacted with the metal roll 10 after paper is passed through, it is necessary to contact the sleeve 2 with the metal roll 10 being rotated. In such a case, paper is broken as soon as the sleeve 2 not being rotated is contacted with paper.

Therefore, in the conventional shoe calender, the sleeve 2 must be held in contact with the metal roll 10 during operation. As a result, the outer periphery of the sleeve 2, which is constructed of a material whose heat-resisting temperature is low (e.g., polyurethane), will reach a considerably high temperature and degrade quickly.

In the conventional shoe calender shown in FIG. 17, the flexible jacket 32 can rotate. That is, the end plate 24 or 26 is driven by a driving unit (not shown). A gear 56 is rotated by a driving shaft 48. In this way, the flexible jacket 32 is rotated. Since the moving speed of the paper sheet 15 can be synchronized with the rotational speed of the flexible jacket 32, breaking of the paper sheet 15 can be reduced.

However, as with the conventional shoe calender shown in FIGS. 13 and 14, the pressurizing shoe 18 contacts with the metal roll 10 at one point on the flexible jacket 32. Therefore, in combination with centrifugal force, etc., the flexible jacket 32 is elliptically deformed when it rotates.

That is, since the flexible jacket 32 is supported only at the position of the pressurizing shoe 18, deformation of the flexible jacket 32 becomes great and it rotates elliptically. Because of this, vibration is generated by rotation and the runout of the jacket 32 occurs. Thus, the calender cannot be operated at a high speed.

SUMMARY OF THE INVENTION

The present invention has been made in view of the above-described circumstances. Accordingly, it is an object of the present invention to provide a calender that is capable of preventing the elliptical deformation of a flexible jacket or cylindrical sleeve (jacket) due to pressurization and thereby preventing vibration which will develop due to the deformation. Another object of the invention is to provide a calender which is capable of suppressing a rise in temperature of the outer periphery of the sleeve member (jacket) to suppress heat degradation.

To achieve the objects of the present invention and in accordance with first means of the invention, there is provided a calender for a sheet of paper comprising a metal roll which is rotated by a first driving unit. The calender further comprises a rotatable cylindrical jacket, a pressurizing shoe, and a plurality of support members. The cylindrical jacket is disposed opposite the metal roll to form a calender nip so that the sheet of paper is continuously passed through the calender nip. The pressurizing shoe is provided within the jacket at the position of the calender nip and presses the interior surface of the jacket radially outward to pressurize the calender nip. The support members are disposed inside the jacket so that they are equally balanced in the peripheral direction of the jacket.

According to the first means, a plurality of support members are disposed inside the jacket so that they are equally balanced in the peripheral direction of the jacket. With the support members equally balanced in the peripheral direction of the jacket, deformation of the jacket due to rotation of the jacket can be prevented, and the occurrence of vibration due to the jacket deformation can be prevented.

In accordance with second means of the present invention, each of the support members comprises a shoe. At the position opposite to one of the support shoes through the jacket, there is provided ad riving roll which is pressed against the jacket to rotate the jacket.

According to the second means, in addition to the support members equally balanced in the peripheral direction of the jacket, the driving roll is disposed at the position opposite to the support shoe through the jacket. Since the jacket is supported at the inner and outer peripheries, deformation during rotation is reliably prevented. In addition, because the jacket is rotated by the driving roll, driving force is assured even if there is a gap between the metal roll and the jacket when a sheet of paper is passed between the metal roll and the jacket. As a result, a sheet of paper can be easily passed between the metal roll and the jacket.

In accordance with third means of the present invention, the support shoe comprises a plurality of divided type shoes divided an axial direction.

According to the third means, the support shoe is divided into small shoes. As a result, the contact area between the support shoes and the jacket is reduced and the friction resistance is reduced. Therefore, the driving load of the second driving unit can be reduced and the power of the second driving unit can be saved.

In accordance with fourth means of the present invention, a surface of the support shoe is provided with grooves which extend in a direction where the jacket rotates.

Since the support shoe is provided with grooves which extends in a direction where the jacket rotates, the lubricating oil that is sprayed inside the jacket flows through the grooves. As a result, there is no possibility that the lubricating oil will stay in the bottom of the jacket. Thus, the jacket is more smoothly rotated.

In accordance with fifth means of the present invention, a surface of the support shoe is provided with grooves which extend obliquely with respect to a direction where the jacket rotates.

Since the support shoe is provided with oblique grooves, the lubricating oil that is sprayed inside the jacket flows through the oblique grooves. As a result, there is no possibility that the lubricating oil will stay in the bottom of the jacket. Thus, the jacket is more smoothly rotated.

In accordance with sixth means of the present invention, one of the support members comprises a rotatable roll. At the position opposite to the support roll through the jacket, there is provided a driving roll which is pressed against the jacket to rotate the jacket.

In addition to the support members equally balanced in the peripheral direction of the jacket, the driving roll is disposed at the position opposite to the support shoe through the jacket. Since the jacket is supported at the inner and outer peripheries, deformation during rotation is reliably prevented. In addition, because the jacket is rotated by the driving roll, driving force is assured even if there is a gap between the metal roll and the jacket when a sheet of paper is passed between the metal roll and the jacket. As a result, a sheet of paper can be easily passed between the metal roll and the jacket. Furthermore, since the support member is constructed of a rotatable roll, the friction resistance with the jacket is reduced. As a result, the driving load of the second driving unit can be reduced and power can be saved.

In accordance with seventh means of the present invention, the support roll comprises a plurality of divided type rolls divided an axial direction.

Since the support roll is divided into small rolls, the contact area between the support rolls and the jacket is reduced and the friction resistance is reduced. Therefore, the driving load of the second driving unit can be reduced and the power of the second driving unit can be saved.

In accordance with eighth means of the present invention, the outer periphery of the support roll is provided with grooves which extend in the peripheral direction.

Since the outer periphery of the support roll is provided with grooves which extend in the circumferental direction, the lubricating oil that is sprayed inside the jacket flows through the grooves. As a result, there is no possibility that the lubricating oil will stay in the bottom of the jacket. Thus, the jacket is more smoothly rotated.

In accordance with ninth means of the present invention, the outer periphery of the support roll is provided with grooves which extend in spiral form.

Since the outer periphery of the support roll is provided with spiral grooves, the lubricating oil that is sprayed inside the jacket flows through the spiral grooves. As a result, there is no possibility that the lubricating oil will stay in the bottom of the jacket. Thus, the jacket is more smoothly rotated.

In accordance with tenth means of the present invention, the driving roll comprises a plurality of divided type rolls divided in an axial direction.

Because the driving roll is divided into small rolls, the size is reduced. As a result, power of the driving motor for rotating the driving roll can be saved.

In accordance with eleventh means of the present invention, there is provided a doctor blade which abuts the jacket, at the position opposite to one of the support members through the jacket.

In addition to the support members equally balanced in the peripheral direction of the jacket, the doctor blade is disposed at the position opposite to the support shoe through the jacket. Because the jacket is supported at the inner and outer peripheries, deformation during rotation is reliably prevented. Furthermore, since dust on the surface of the jacket is removed, the calender effect can be further enhanced.

In accordance with twelfth means of the present invention, the doctor blade comprises a plurality of divided type doctor blades divided in an axial direction of the jacket.

Since the doctor blade is divided into small doctor blades, the contact area between the doctor blades and the jacket is reduced. Therefore, wear on the jacket can be saved.

In accordance with thirteenth means of the present invention, the doctor blades are slidable in the axial direction of the jacket.

Since the doctor blades are slidable in the axial direction of the jacket, dust on the entire surface of the jacket can be removed even if the contact area between the doctor blade and the jacket is reduced. As a result, power can be saved and wear can be prevented.

In accordance with fourteenth means of the present invention, the calender further comprises (1) a roll-moving unit for moving the jacket, the driving roll, and the doctor blade between a first position where the jacket is pressed against the metal roll and a second position where the jacket, the driving roll, and the doctor blade are moved away from the metal roll, and (2) a controller for controlling the roll-moving unit and a second driving unit which drives the driving roll. The controller controls the roll-moving unit so that until speed of the jacket is synchronized with speed of the metal roll, the jacket is held at the second position. The controller also controls speed of the second driving unit so that the speed of the jacket is synchronized with the speed of the metal roll. Furthermore, the controller controls the roll-moving unit so that after the speed of the jacket is synchronized with the speed of the metal roll, the jacket is held at the first position. The controller performs drooping control on the second driving unit after the jacket is held at the first position.

According to the fourteenth means, the jacket is held at the second position until speed of the jacket is synchronized with speed of the metal roll. Therefore, heating of the jacket is prevented and heat degradation is prevented. Furthermore, drooping control is performed on the second driving unit after the jacket is held at the first position. Therefore, a paper sheet can be stably traveled.

In accordance with fifteenth-means of the present invention, the controller controls driving torque of the second driving unit to perform load allotment control with the first driving unit as a master side, after pressurization by the pressurizing shoe is performed at the position of the calender nip. The controller allots a load on the second driving unit to the first driving unit and gradually reduces the driving torque of the second driving unit to zero, if the load allotment between the first driving unit and the second driving unit is stabilized.

According to the fifteenth means, the controller controls driving torque of the second driving unit to perform load allotment control with the first driving unit as a master side. The controller gradually reduces the driving torque of the second driving unit to zero. As a result, a sudden change in the driving torque that is applied to a paper sheet of paper is avoided and cutting of the paper sheet is prevented.

In accordance with sixteenth means of the present invention, the controller disconnects the driving roll from the jacket after the driving torque of the second driving unit is gradually reduced to zero, and then stops the speed of the second driving unit.

Because the speed of the second driving unit is stopped, the output load and control load of the second driving unit can be saved.

DESCRIPTION OF THE PREFERRED EMBODIMENTS

Figure 1:
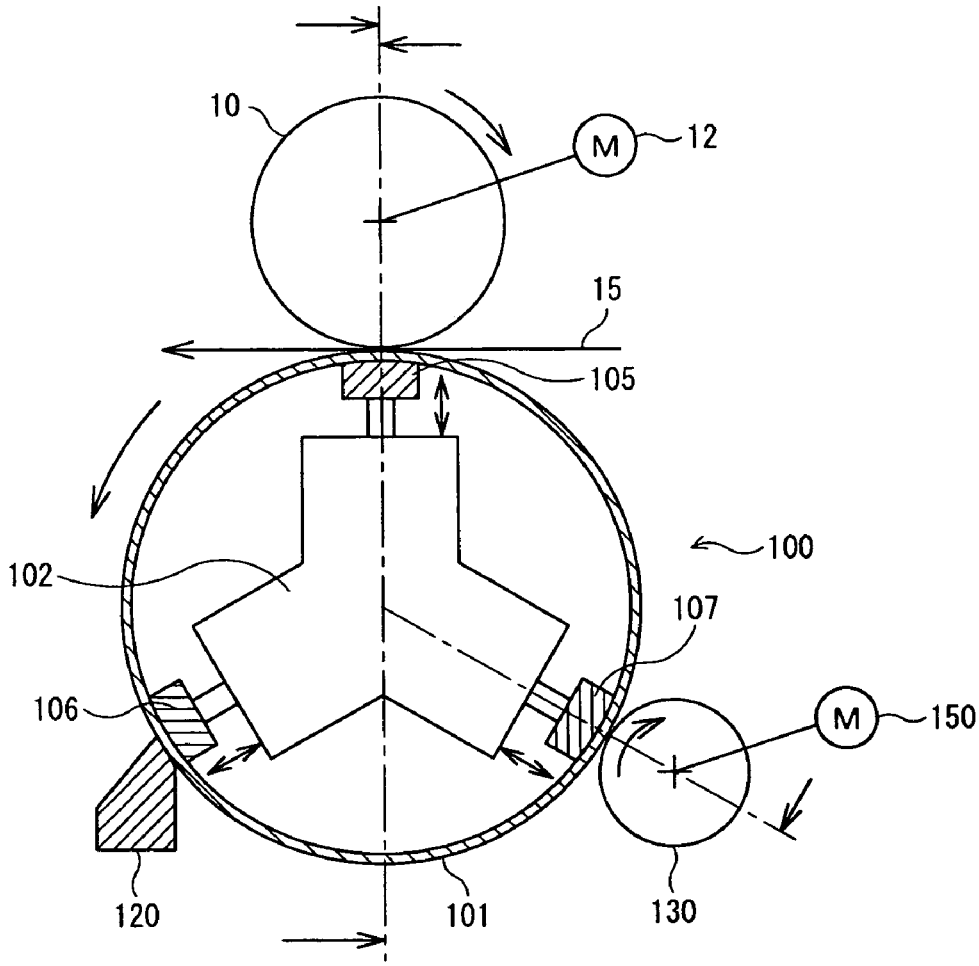
FIG. 1 is a cross sectional view showing a calender constructed in accordance with a first embodiment of the present invention.
Figure 2:
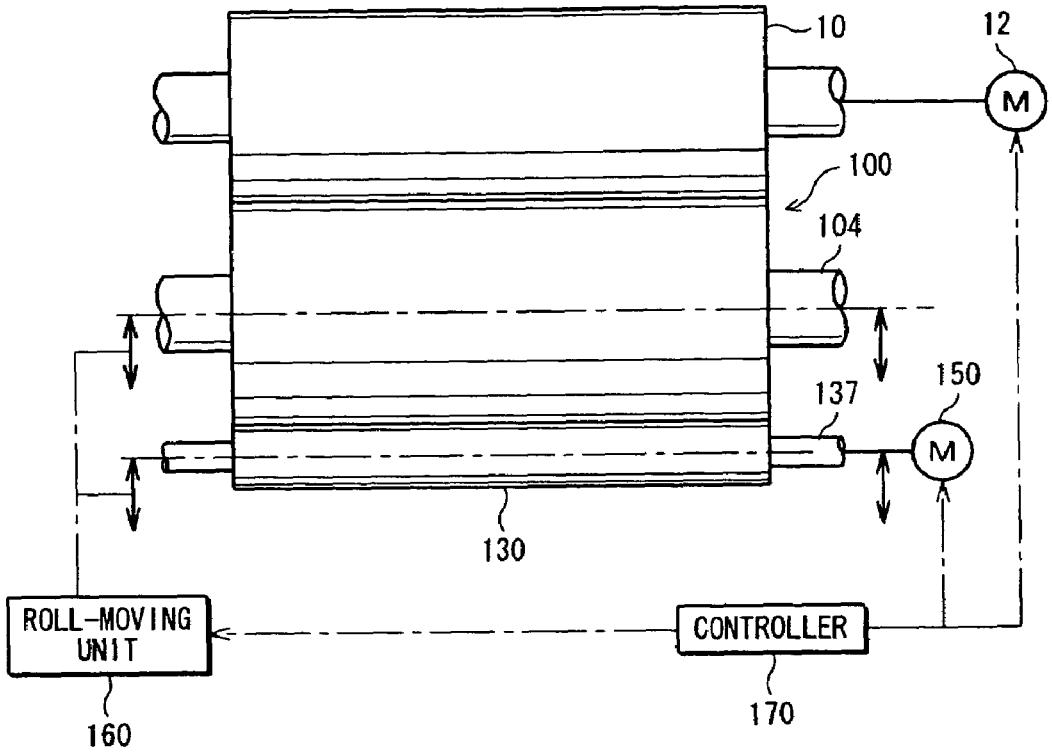
FIG. 2 is a diagrammatic rear view of the driving roll in the first embodiment shown in FIG. 1.
Figure 3:
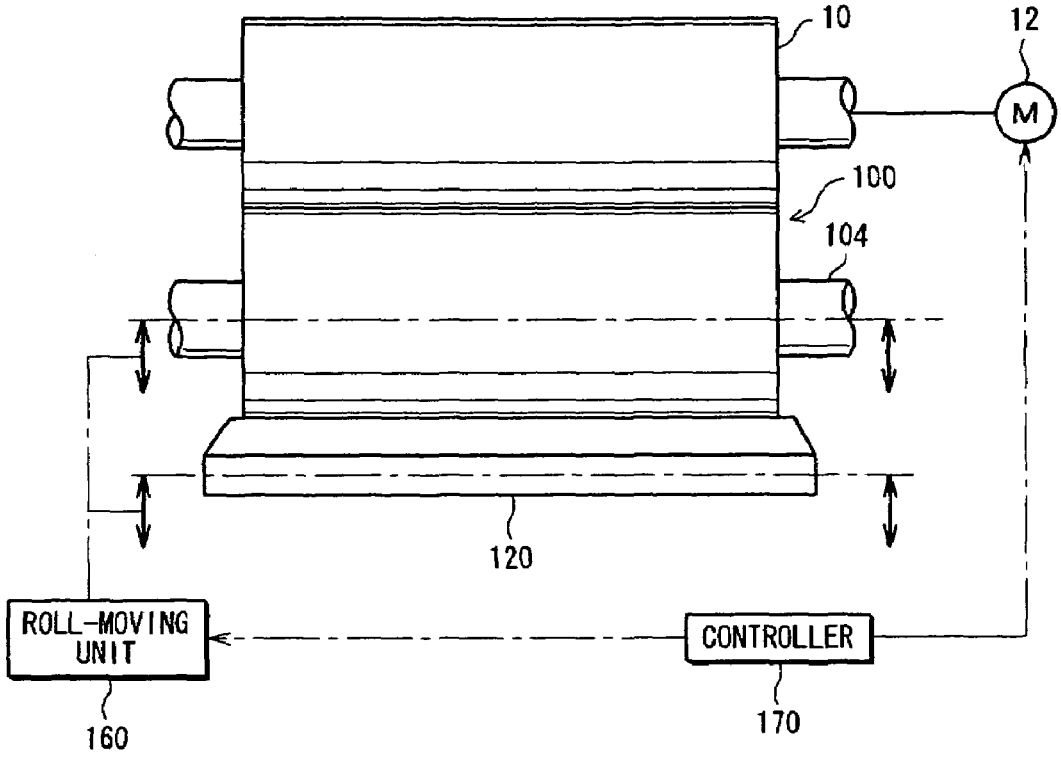
FIG. 3 is a diagrammatic front view of the doctor blade in the first embodiment shown in FIG. 1.

Referring now in greater detail to the drawings and initially to FIGS. 1 through 3, there is shown a calender constructed in accordance with a first embodiment of the present invention. In the first embodiment, a rotatable metal roll 10 and a pressurizing roll 100 are disposed at the opposite positions through a paper sheet 15. The outer periphery of the pressurizing roll 100 is provided with a resin jacket 101. Inside the jacket 101, there is provided a stationary base 102.

A recessed, pressurizing shoe 105 and support shoes 106 and 107 are provided on the base 102 for the purpose of forming a pressuring nip (calender nip) for a calendering process. The pressurizing shoe 105 and support shoes 106, 107 are disposed at three positions shifted 120 degrees from each other so that they are equally balanced. Note that the pressurizing force of the pressurizing shoe 105 and the pressurizing forces of the support shoes 106,107 can be independently adjusted.

The resin jacket 101 is supported at its outer periphery by a driving roll 130 disposed opposite the second support shoe 107. The resin jacket 101 is rotated by rotation of the driving roll 130.

A doctor blade 120 is disposed opposite the first support shoe 106 shifted 120 degrees from the second support shoe 107, and contacts the surface of the jacket 101 to remove paper dust adhering to the surface of the jacket 101.

The driving roll 130, as shown in FIG. 2, extends over the entire axial length of the pressurizing roll 100 and is rotated by a driving motor 150. The rotation of the driving roll 130 causes the pressurizing roll 100 to rotate.

The doctor blade 120, as shown in FIG. 3, is constructed of a stationary doctor blade extending over the entire length of the pressurizing roll 100. The doctor blade 120 abuts the surface of the jacket 101 at the position opposite to the first support shoe 106 to hold the jacket 101.

In the above-described first embodiment, even when the jacket 101 is protruded by the pressuring shoe 105 pressurized for a calendering process, the support shoes 106, 107 protrude outward in the radial direction of the jacket 101 at the same time so that the circular shape of the jacket 101 is held.

In addition, even if the jacket 101 bulges due to deformation caused by applied pressure and rotation, the driving roll 130 and doctor blade 120 act on the outer periphery of the jacket 101 to prevent deformation. As a result, the jacket 101 can be held in a state near to a circle.

As shown in FIG. 2, the calender of the first embodiment is equipped with a driving motor (second driving motor) 150 which drives the driving roll 130 that rotates the jacket 100, and a roll-moving unit 160 which moves the jacket 101 between a first position where the jacket 101 is pressed against the metal roll 10 and a second position where the jacket 101 is moved away from the metal roll 10. The calender is also equipped with a driving motor (first driving motor) 12 which drives the metal roll 10. The motor 12 for driving the metal roll 10 will hereinafter be referred to as a first driving motor. The motor 150 for driving the driving roll 130 will hereinafter be referred to as a second driving motor. The first driving motor 12 functions as a master motor, while the second driving motor 150 functions as a helper motor.

The roll-moving unit 160 is constructed, for example, of fluid pressure cylinders such as hydraulic cylinders and air cylinders, which are provided on the opposite ends of a center shaft 104 which is the center shaft of the pressurizing roll 100 and on the opposite ends of a center shaft 137 which is the center shaft of the driving roll 130. If the jacket 101 and the driving roll 130 are moved toward and away from the metal roll 10 by the fluid pressure cylinders (see vertical arrows in FIG. 2), the jacket 101 can be moved between a first position where the jacket 101 is pressed against the metal roll 10 and a second position where the jacket 101 is moved away from the metal roll 10. Similarly, the doctor blade 120 can be moved in an up-and-down direction by the roll-moving unit 160 (see vertical arrows in FIG. 3).

In response to an electrical signal from a controller (control means) 170, the second driving motor 150 and roll-moving unit 160 are controlled. The controller (control means) 170 also controls the first driving motor 12 that drives the metal roll 10. However, a description will be given of how the second driving motor 150 and roll-moving unit 160 are controlled by the controller 170.

Initially, at the above-described second position, the controller 170 controls the speed of the second driving motor 150. That is, the rotational speed of the second driving motor 150 is synchronized with the rotational speed of the first driving motor 12 serving as a master motor. More specifically, the peripheral speed of the outer periphery of the jacket 101 is synchronized with the peripheral speed of the outer periphery of the metal roll 10 by the driving roll 130. At the: second position, direct contact between the high-temperature metal roll 10 and the jacket 101 is avoided because the jacket 101 is held away from the metal roll 10.

Therefore, the problem of the heating of the jacket 101 by the metal roll 10 is overcome. As a result, heat degradation of the jacket 101 is prevented. Even if the heat-resisting temperature of an elastic synthetic resin layer (e.g., a polyurethane resin layer) mounted on the exterior layer of the jacket 101 is low, the exterior layer will not reach the heat-resisting temperature. Thus, the durability of the exterior layer of the jacket 101 can be enhanced.

If the rotational speed of the second driving motor 150 (peripheral speed of the outer peripheral of the jacket 101) synchronizes with the rotational speed of the first driving motor 12 (peripheral speed of the outer peripheral of the metal roll 10), the roll-moving unit 160 is operated so that the jacket 101 is pressed against the metal roll 10. When the rotational speed of the jacket 101 is equal to that of the metal roll 10, there is no difference in speed between the surface of the jacket 101 and the paper sheet 15. Therefore, even if the paper sheet 15 is nipped by the jacket 101 and the metal roll 10, the paper sheet 15 will not be broken.

After the jacket 101 is pressed against the metal roll 10, the second driving motor 150 is droop-controlled. In the drooping control, if a load current through the second driving motor 150 increases, the speed of the second driving motor 150 is decreased. That is, a load on the second driving motor 150 is stabilized by controlling the speed of the second driving motor 150. Since the drooping control stabilizes the allotment of a driving load between the first driving motor 12 and the second driving motor 150, the paper sheet 15 can be stably passed between the metal roll 10 and the jacket 101.

If the load allotment between the first driving motor 12 and the second driving motor 150 is stabilized, the paper sheet 15 is pressurized by the pressurizing shoe 105. Thereafter, the drooping control change to torque control. Torque control is performed to change the load allotment (torque allotment) between the second driving motor 150 and the first driving motor 12. The torque control is the control of changing the load allotment between the second driving motor 150 and the first driving motor 12. In the first embodiment, the load allotment of the second driving motor 150 of the jacket 101 is reduced, while the load allotment of the first driving motor 12 is increased by the amount of the reduced load allotment of the second driving motor 150. Finally, the driving torque of the second driving motor 150 is gradually reduced to zero (typically for one to two minutes).

Thus, since the torque control is performed after stabilization of the load allotment, the torque control is prevented from being performed when the load allotment is unstable. Therefore, a sudden change in the driving torque applied from the jacket 101 and metal roll 10 to the paper sheet 15 is avoided, and the breaking of the paper sheet 15 at this stage can be prevented.

As described above, the reduced load is allotted to the first driving motor 12. Therefore, during normal operation, the jacket 101 is driven by the metal roll 10 instead of being driven by the second driving motor 150. As a result, there is an advantage that the load on the second driving motor 150 to drive the jacket 101 can be reduced. There is also an advantage that the control load for rotating the second driving motor 150 in synchronization with rotation of the metal roll 10 can be reduced.

A one-way clutch which does not transmit torque may be provided between the second driving motor 150 and the driving roll 130. In this case, if the load on the jacket 101 is allotted to the metal roll 10 after the jacket 101 is pressed against the metal roll 10, and the speed of the second driving motor 150 is stopped (or reduced), the jacket 101 will be driven by the metal roll 10 instead of being driven by the second driving motor 150. At this time, there is no possibility that a torque load will be transmitted from the second driving motor 150 to the metal roll 10. Therefore, with a simple structure, the jacket 101 can follow the metal roll 10 during normal operation.

That is, between the second driving motor 150 and the jacket 101, there may be provided a driving-force transmission line changing mechanism, such as a one-way clutch, which changes a driving-force transmission line so that the transmission of a driving force from the second driving motor 150 to the driving roll 130 is cut off and that the jacket 101 is driven by the metal roll 10, if the rotational speed or driving force of the second driving motor 150 is reduced when the jacket 101 is pressed against the metal roll 10.

In this case, the driving roll 130 is rotated by rotation of the jacket 101, and consequently, there is obtained an advantage that the driving roll 130 functions as a support roll that prevents vibration of the jacket 101.

Note that after the driving load of the second driving motor 150 for rotating the driving roll 130 is reduced to zero, the driving roll 130 may be moved away from the jacket 101 by the roll-moving unit 160. In such a case, the driving load of the first driving motor 12 can be reduced.

In the first embodiment, the driving roll 130 and the doctor blade 120, along with the pressurizing roll 100, are moved in the up-and-down direction to nip the paper sheet 15 therebetween. However, the driving roll 130 and the doctor blade 120 do not always need to be moved in the same direction as the pressuring roll 100. For example, they may be moved in a lateral direction.

Now, a second embodiment of the present invention will be described with reference to FIG. 4.

Figure 4:
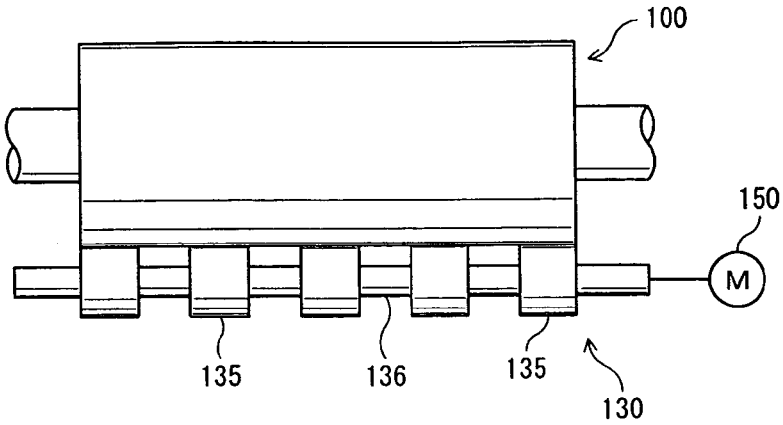
FIG. 4 is a diagram showing the driving roll of a calender constructed in accordance with a second embodiment of the present invention.

FIG. 4 shows the driving roll of a calender constructed in accordance with the second embodiment of the present invention. In the second embodiment, the driving roll 130 in the above-described first embodiment is replaced with a divided type. Since the remaining construction is the same as the first embodiment, a description will be given of different parts. Note in FIG. 4 that the same parts as FIG. 2 are represented by the same reference numerals.

A driving roll 130 in the second embodiment is constructed of a plurality of rolls 135 divided in the axial direction of a pressurizing roll 100. The rolls 135 are rotated by a driving motor 150 through a connecting shaft 136. The weight of the rolls 135 of the second embodiment is reduced, compared with the driving roll 130 of the first embodiment. As a result, power of the driving motor 150 can be saved. In addition, since the jacket 101 is supported at the interior and exterior surfaces thereof by the support shoe 107 and the driving roll 130, vibration of the jacket 101 can be prevented.

Now, a third embodiment of the present invention will be described with reference to FIG. 5.

Figure 5:
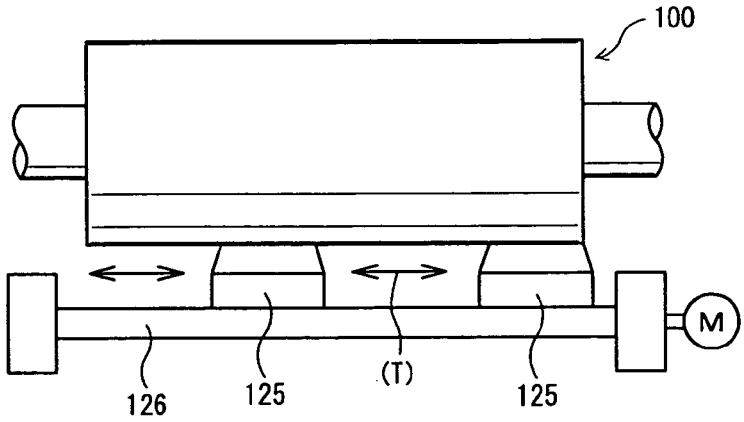
FIG. 5 is a diagram showing the doctor blade of a calender constructed in accordance with a third embodiment of the present invention.

FIG. 5 shows the doctor blade of a calender constructed in accordance with the third embodiment of the present invention. In the third embodiment, the doctor blade 120 in the above-described first embodiment is replaced with a divided type. Since the remaining construction is the same as the first embodiment, a description will be given of different parts. Note in FIG. 5 that the same parts as FIG. 3 are represented by the same reference numerals.

A doctor blade 120 in the third embodiment is constructed of two doctor blades divided in the axial direction of a pressurizing roll 100. The two doctor blades 125 are disposed on a support plate 126 with a space. The doctor blades 125 are slid a predetermined quantity in the axial direction of the pressurizing roll 100 by a driving unit M so that paper dust, etc., are removed over the entire surface of the jacket 101 of the pressurizing roll 100.

According to the third embodiment, the doctor blade 120 is constructed of two divided doctor blades 125. Therefore, the contact area between the doctor blades 125 and the jacket 101 is reduced and wear on the jacket 101 is saved. The third embodiment is provided with two doctor blades 125 slidable in the axial direction of the pressurizing roll 100. However, the doctor blade of the present invention may comprise one doctor blade slidable in the axial direction, or it may comprise two or more doctor blades slidable in the axial direction.

Now, a fourth embodiment of the present invention will be described with reference to FIG. 6.

Figure 6:
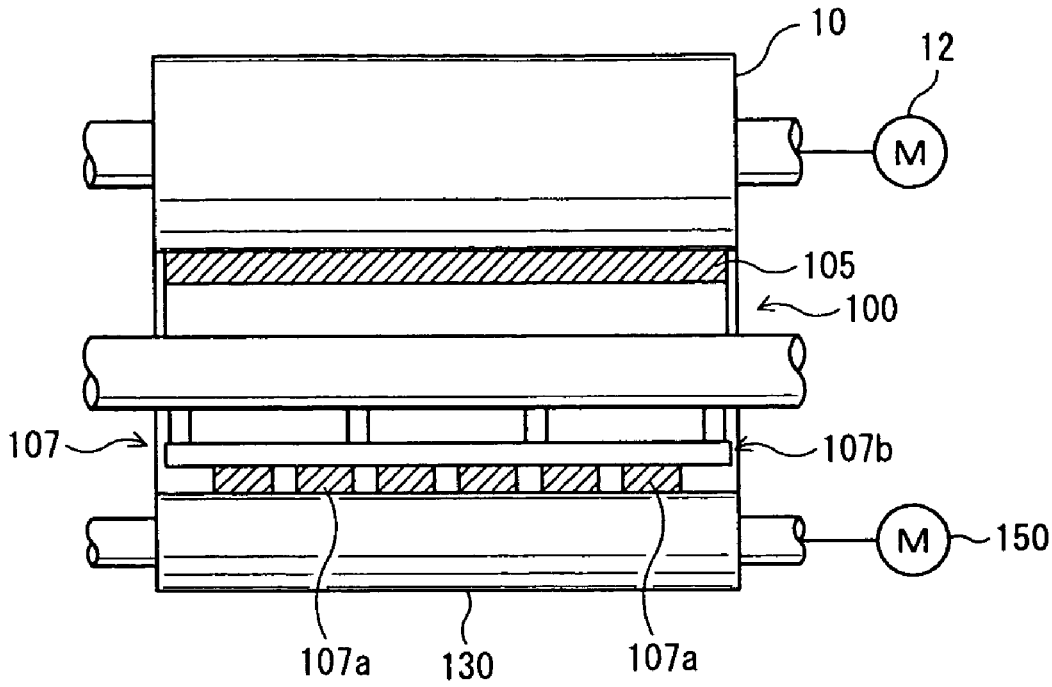
FIG. 6 is a sectional view showing the support shoes of a calender constructed in accordance with a fourth embodiment of the present invention.

FIG. 6 shows the support shoes of a calender constructed in accordance with the fourth embodiment of the present invention. In the fourth embodiment, the support shoe 107 in the above-described first embodiment is replaced with a divided type. Since the remaining construction is the same as the first embodiment, a description will be given of different parts. Note in FIG. 6 that the same parts as FIG. 2 are represented by the same reference numerals.

A support shoe 107 in the fourth embodiment is constructed of 6 support shoes 107*a* divided in the axial direction of a pressurizing roll 100. The support shoes 107*a* are disposed at predetermined intervals on a pressurizing unit 107*b*. The support shoes 107*a* support the jacket 101 along with a driving roll 130 disposed at the position opposite to the support shoes 107*a* through a jacket 101. The jacket 101 is rotated by rotation of the driving roll 130.

According to the fourth embodiment, the support shoe 107 is constructed of 6 divided support shoes 107*a*. Therefore, the contact area between the support shoes 107*a* and the jacket 101 is reduced and wear on the jacket 101 is saved. As a result, the driving load of the driving roll 130 is reduced and the power of the driving motor 150 for driving the driving roll 130 is saved. While the fourth embodiment is provided with 6 support shoes 107*a*, the present invention is not limited to the 6 support shoes 107*a*.

Now, a fifth embodiment of the present invention will be described with reference to FIG. 7.

Figure 7:
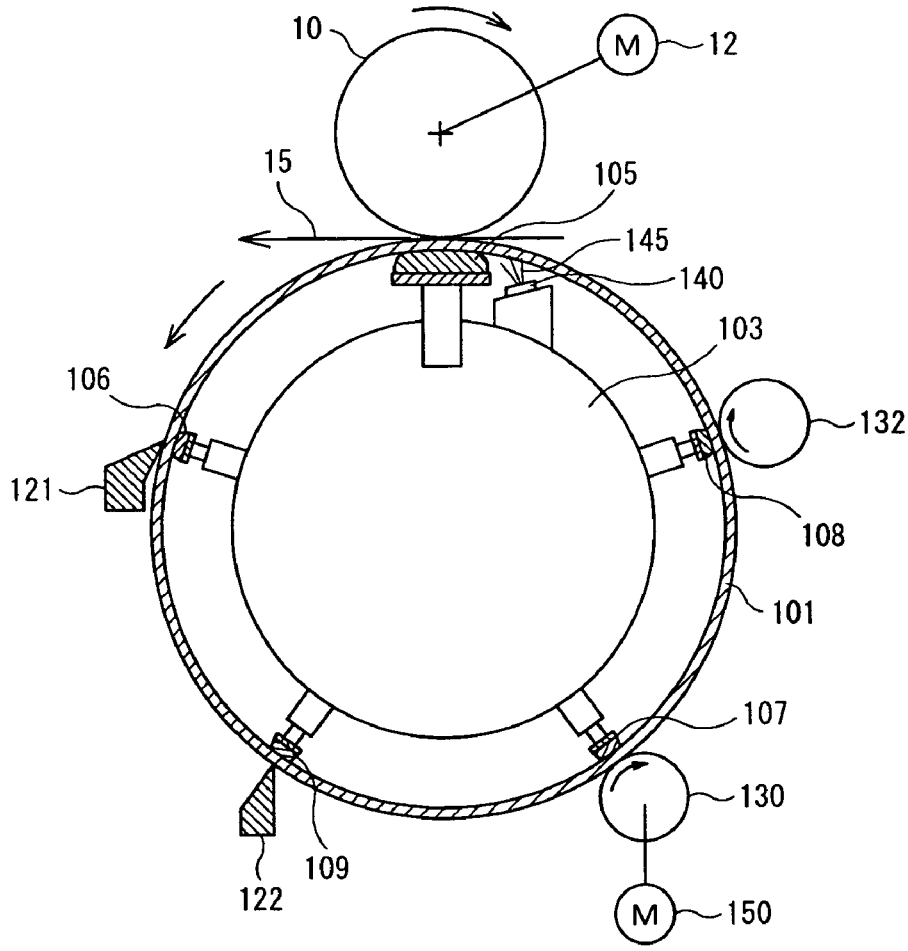
FIG. 7 is a cross sectional view showing a calender constructed in accordance with a fifth embodiment of the present invention.

FIG. 7 shows a calender constructed in accordance with the fifth embodiment of the present invention. In the fifth embodiment, the number of support shoes is increased to support a jacket 101 in a state near to a circle. Since the remaining construction is the same as the first embodiment, a description will be given of different parts. Note in FIG. 7 that the same parts as FIG. 1 are represented by the same reference numerals.

A rotatable metal roll 10 and a pressurizing roll 100 are disposed at the opposite positions through a paper sheet 15. The outer periphery of the pressurizing roll 100 is provided with a resin jacket 101. Inside the jacket 101, there is provided a statinary base 103.

A recessed, pressurizing shoe 105 and support shoes 106 to 109 are provided on the stationary base 103 for the purpose of forming a pressuring nip (calender nip) for a calendering process. The pressurizing shoe 105 and support shoes 106 to 109 are disposed at 5 positions shifted 72 degrees from each other so that they are equally balanced.

A driving roll 130 which is rotated by a driving motor 150, a rotatable support roll 132 having no driving source, and doctor blades 121 and 122 are disposed at the positions opposite to the support shoes 106 to 109 through the jacket 101, respectively. With this arrangement, the jacket 101 is reliably pressurized and held. As a result, the vibration, runout, slippage, etc., of the jacket 101 can be prevented.

A lubricating-oil injection nozzle 140 is provided on the upstream side of the pressurizing shoe 105 to perform lubrication and cooling between the interior surface of the jacket 101 and the pressurizing shoe 105. With lubricating oil 145 sprayed by the lubricating-oil injection nozzle 140, lubrication is performed between the jacket 101, which rotates while being pressurized and held, and the shoes 105 to 109. As a result, the jacket is smoothly rotated and generation of heat is prevented.

Thus, the fifth embodiment, as with the above-described first embodiment, makes high-speed operation possible by preventing the deformation, runout, and vibration of the jacket 101. In addition, since the jacket 101 is pressurized and held at its interior and exterior surfaces, smooth rotation of the jacket 101 is assured and slippage prevention is achieved. By removing dust on the surface of the jacket 101 with the doctor blades 121 and 122, quality is enhanced. At the same time, by reducing and preventing the above-described vibration and runout, the life of the jacket 101 can be prolonged.

The driving roll 130 or support roll 132 in the fifth embodiment may be an integral type, or a divided type described in the second embodiment, or a combination type of them. Similarly, the doctor blade 121 or 122 in the fifth embodiment may be an integral type described in the first embodiment of FIG. 3, or a divided type described in the third embodiment of FIG. 5, or a combination type of them. Likewise, the support shoe 106, 107, 108, or 109 in the fifth embodiment may be an integral type described in the first embodiment of FIG. 1, or a divided type described in the fourth embodiment of FIG. 6, or a combination type of them.

Although not shown in FIG. 7, in the fifth embodiment, as with the above-described first embodiment, drooping control and load allotment control may be performed on the first driving motor 12 and the second driving motor 150 by the roll-moving unit 160 and controller 170. In this case, the same advantages as the first embodiment can be obtained.

Now, a sixth embodiment of the present invention will be described with reference to FIGS. 8A and 8B.

Figure 8A:
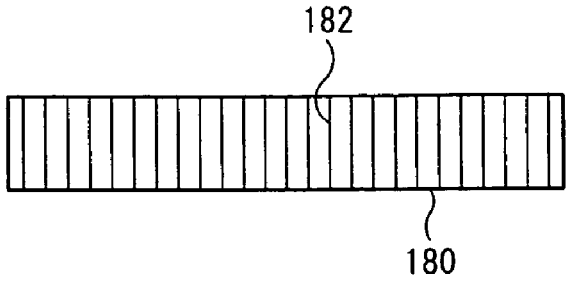
FIGS. 8A and 8B are plan views showing the contact surfaces of the support rolls of a calender constructed in accordance with a sixth embodiment of the present invention.
Figure 8B:
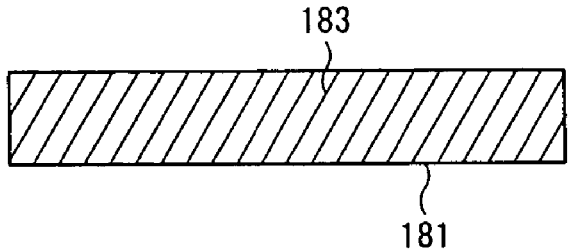

FIGS. 8A and 8B show the contact surfaces of the support rolls of a calender constructed in accordance with the sixth embodiment of the present invention. In the sixth embodiment, the support shoe in the above-described fifth embodiment of FIG. 7 is provided with grooves. Since the remaining construction is the same as the fifth embodiment, a description will be given of different parts.

A support shoe 180 shown in FIG. 8A is disposed inside the jacket 101 of FIG. 7 at the position opposite to the driving roll 130 of FIG. 7. The outer periphery of the support shoe 180 is provided with grooves 182, which extend in a direction where the above-described jacket 101 rotates.

A support shoe 181 in FIG. 8B, as with the support shoe 180 of FIG. 8A, is disposed inside the jacket 101 of FIG. 7 at the position opposite to the driving roll 130 of FIG. 7. The outer periphery of the support shoe 181 is provided with grooves 183, which extend obliquely with respect to the direction where the above-described jacket 101 rotates.

According to the sixth embodiment, the lubricating oil 145 sprayed by the injection nozzle 140 of FIG. 7 flows through the grooves 182 or 183 formed in the support roll 180 or 181 by rotation of the jacket 101. That is, the lubricating oil 145 can flow smoothly toward the downstream side. Therefore, since the lubricating oil 145 does not stay in the bottom of the jacket 101, smoother rotation of the jacket 101 becomes possible.

In the sixth embodiment, the support shoes 106, 108, and 109 of the fifth embodiment shown in FIG. 7 may also be provided with the above-described grooves 182 or 183. In the case where all the support shoes are provided with the grooves 182 or 183, the lubricating oil 145 can flow along the entire interior surface of the jacket 101 and therefore smoother rotation of the jacket 101 becomes possible. Furthermore, the support shoe 107*a* of the fourth embodiment of FIG. 6 may be provided with the grooves 182 or 183.

Now, a seventh embodiment of the present invention will be described with reference to FIGS. 9 and 10.

Figure 9:
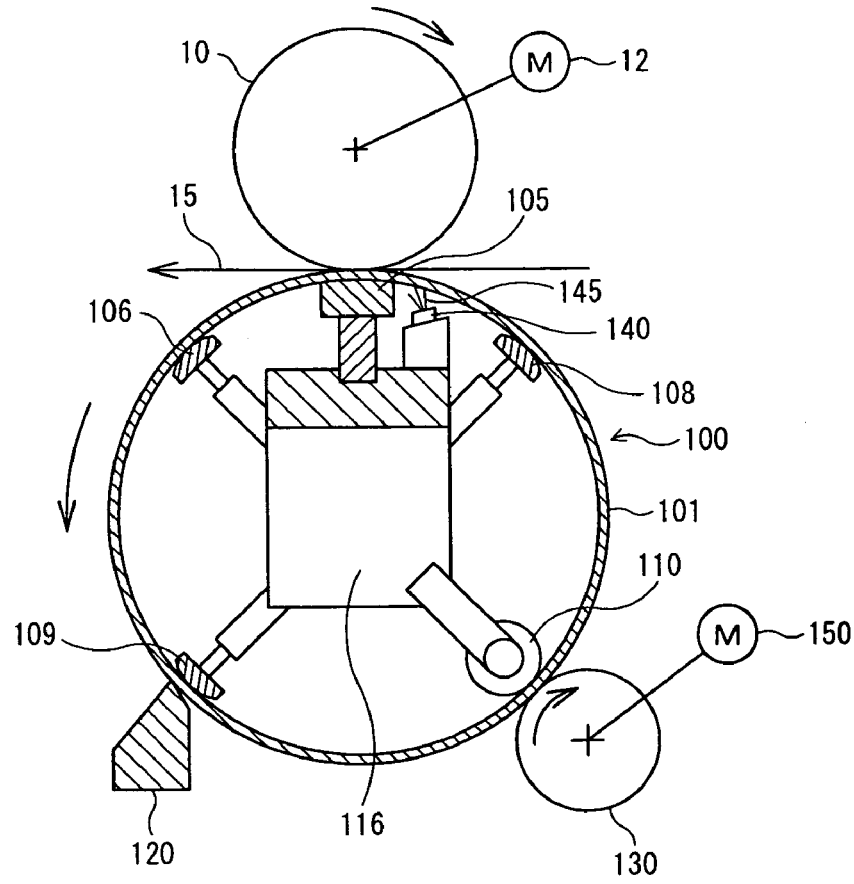
FIG. 9 is a cross sectional view showing a calender constructed in accordance with a seventh embodiment of the present invention.

FIG. 9 shows a calender constructed in accordance with the seventh embodiment of the present invention. FIG. 10 shows the support roll of the calender. In the seventh embodiment, the number of support shoes in the above-described first embodiment is increased to hold a jacket 101. At the position opposite to a driving roll 130, a support member is provided with a rotatable roll. Since the remaining construction is the same as the first embodiment, a description will be given of different parts. Note in FIGS. 9 and 10 that the same parts as FIGS. 1 and 2 are represented by the same reference numerals.

A rotatable metal roll 10 and a pressurizing roll 100 are disposed at the opposite positions through a paper sheet 15. The outer periphery of the pressurizing roll 100 is provided with a resin jacket 101. Inside the jacket 101, there is provided a stationary base 116.

A recessed, pressurizing shoe 105 and support shoes 106, 108, 109, and a support roll 110 are provided on the stationary base 116. The support shoes 106, 108, 109, and a support roll 110 are disposed symmetrically with respect to the pressurizing shoe 105 at 4 positions shifted 90 degrees from each other so that they are equally balanced.

A driving roll 130 which is rotated by a driving motor 150 is disposed at the position opposite to a support roll 110 through the jacket 101. A doctor blade 120 is disposed at the position opposite to the support shoe 106 109 through the jacket 101. With this arrangement, the jacket 101 is reliably pressurized and held. As a result, the vibration, runout, slippage, etc., of the jacket 101 can be prevented.

A lubricating-oil injection nozzle 140 is provided on the upstream side of the pressurizing shoe 105 to perform lubrication and cooling between the interior surface of the jacket 101 and the pressurizing shoe 105, support members 106, 108, 109, 110. With lubricating oil 145 sprayed by the lubricating-oil injection nozzle 140, lubrication is performed between the jacket 101, which rotates while being pressurized and held, and the pressurizing shoe 105, support members 106, 108, 109, 110. As a result, the jacket 101 is smoothly rotated and generation of heat is prevented.

Figure 10:
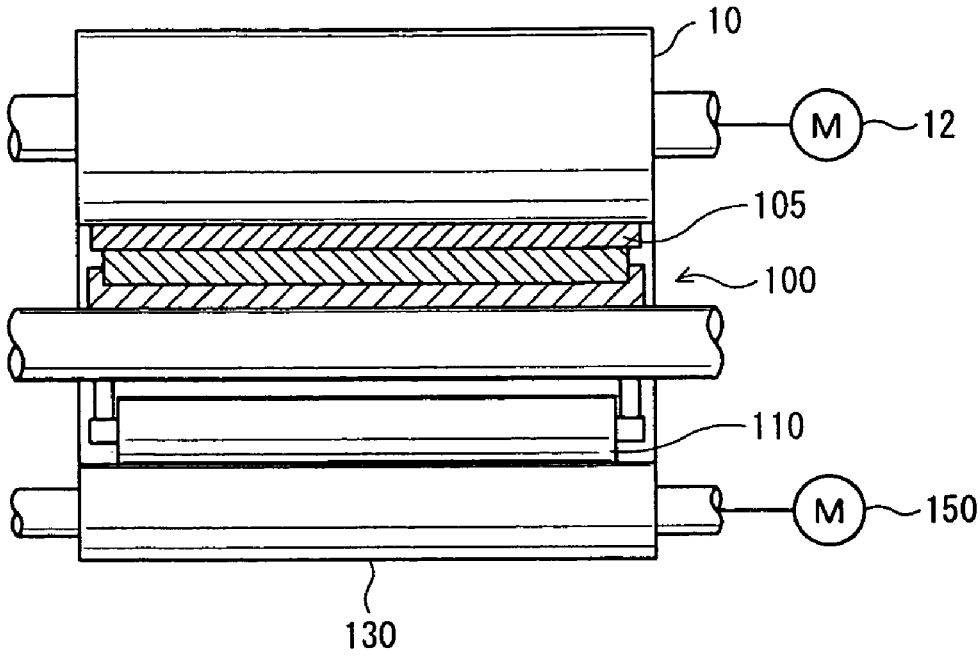
FIG. 10 is a diagram showing the support roll of the calender of the seventh embodiment.

Thus, the seventh embodiment of FIG. 9, FIG. 10, as with the above-described first embodiment, makes high-speed operation possible by preventing the deformation, runout, and vibration of the jacket 101. In addition, since the jacket 101 is pressurized and held at its interior and exterior surfaces, smooth rotation of the jacket 101 is assured and slippage prevention is achieved. The life of the jacket 101 can be prolonged.

Further in the seventh embodiment, the support member disposed opposite the driving roll 130 is the rotatable roll 110. This roll 110 can reduce the friction resistance between itself and the jacket 101 which develops when the jacket 101 is rotated by the driving roll 130. Because the jacket 101 rotates smoothly, the power of the driving motor 150 for driving the driving roll 130 can be saved.

The seventh embodiment, as with the fifth embodiment of FIG. 7, may be provided with the rotatable support shoe 132 at the position opposite to the support shoe 108 through the jacket 101. The seventh embodiment may also be provided with the doctor blade 121 at the position opposite to the support shoe 106 through the jacket 101.

As in the sixth embodiment of FIG. 8, the support shoes 106, 108, and 109 of the seventh embodiment may be provided with the grooves 182 or 183.

The structure of the support shoes 106, 108, and 109 can be made the same as the structure of the support roll 110.

Although not shown in FIG. 10, in the seventh embodiment, as with the above-described first embodiment, drooping control and load allotment control may be performed on the first driving motor 12 and the second driving motor 150 by the roll-moving unit 160 and controller 170. In this case, the same advantages as the first embodiment can be obtained.

Now, an eighth embodiment of the present invention will be described with reference to FIGS. 11A and 11B.

Figure 11A:
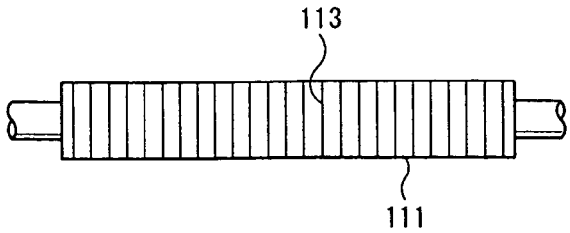
FIGS. 11A and 11B are plan views showing the contact surfaces of the support rolls of a calender constructed in accordance with an eighth embodiment of the present invention.
Figure 11B:
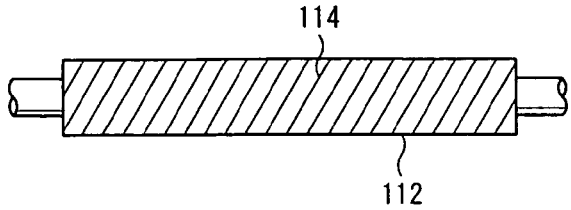

FIGS. 11A and 11B show the support rolls of a calender constructed in accordance with the eighth embodiment of the present invention, respectively. In the eighth embodiment, the support roll 110 in the above-described seventh embodiment of FIG. 10 is provided with grooves. Since the remaining construction is the same as the seventh embodiment, a description will be given of different parts.

A support roll 111 shown in FIG. 11A is disposed inside the jacket 101 of FIG. 10 at the position opposite to the driving roll 130 of FIG. 10. The outer periphery of the support roll 111 is provided with grooves 113, which extend in the peripheral direction.

A support roll 112 in FIG. 11B, as with the support roll 111 of FIG. 11A, is disposed inside the jacket 101 of FIG. 7 at the position opposite to the driving roll 130 of FIG. 7. The outer periphery of the support roll 112 is provided with grooves 114, which extend in spiral form.

According to the eighth embodiment, the lubricating oil 145 sprayed by the injection nozzle 140 of FIG. 7 flows through the grooves 113 or 114 formed in the support roll 111 or 112 by rotation of the jacket 101. That is, the lubricating oil 145 can flow smoothly toward the downstream side. Therefore, since the lubricating oil 145 does not stay in the bottom of the jacket 101, smoother rotation of the jacket 101 becomes possible.

Now, a ninth embodiment of the present invention will be described with reference to FIG. 12.

Figure 12:
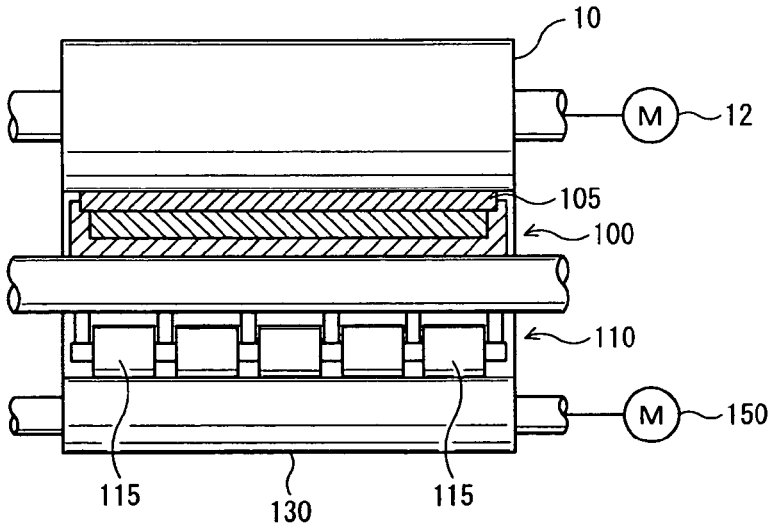
FIG. 12 is a sectional view showing the support roll of a calender constructed in accordance with a ninth embodiment of the present invention.
Figure 13:
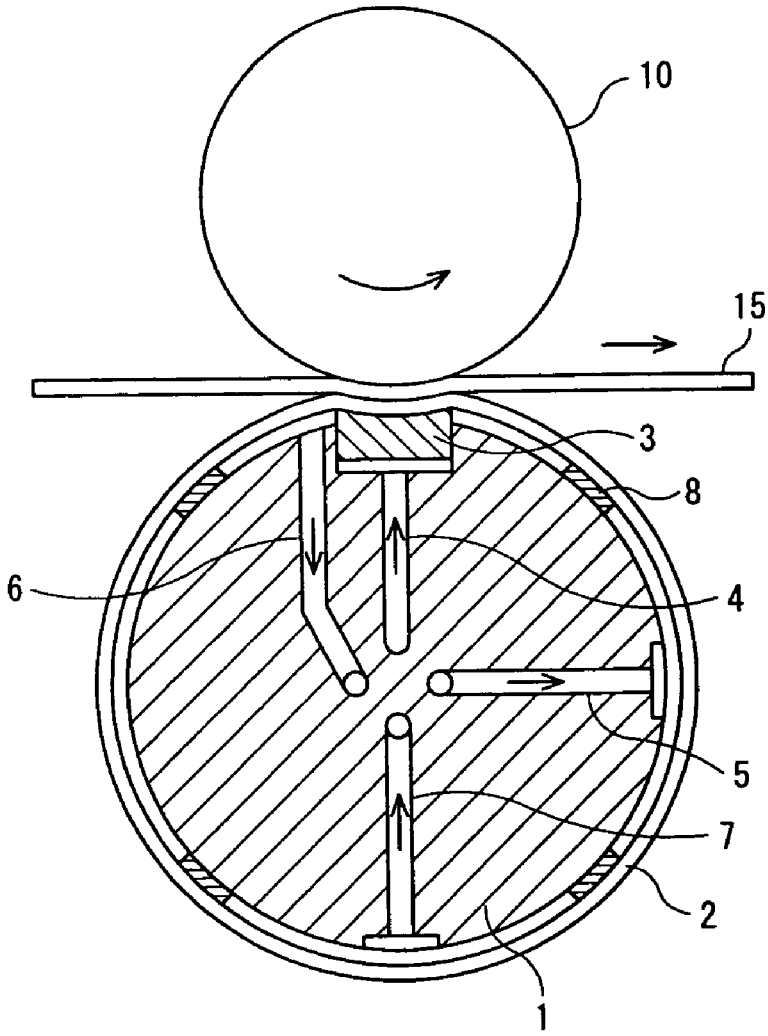
FIG. 13 is a cross sectional view showing a conventional shoe calender.
Figure 14:
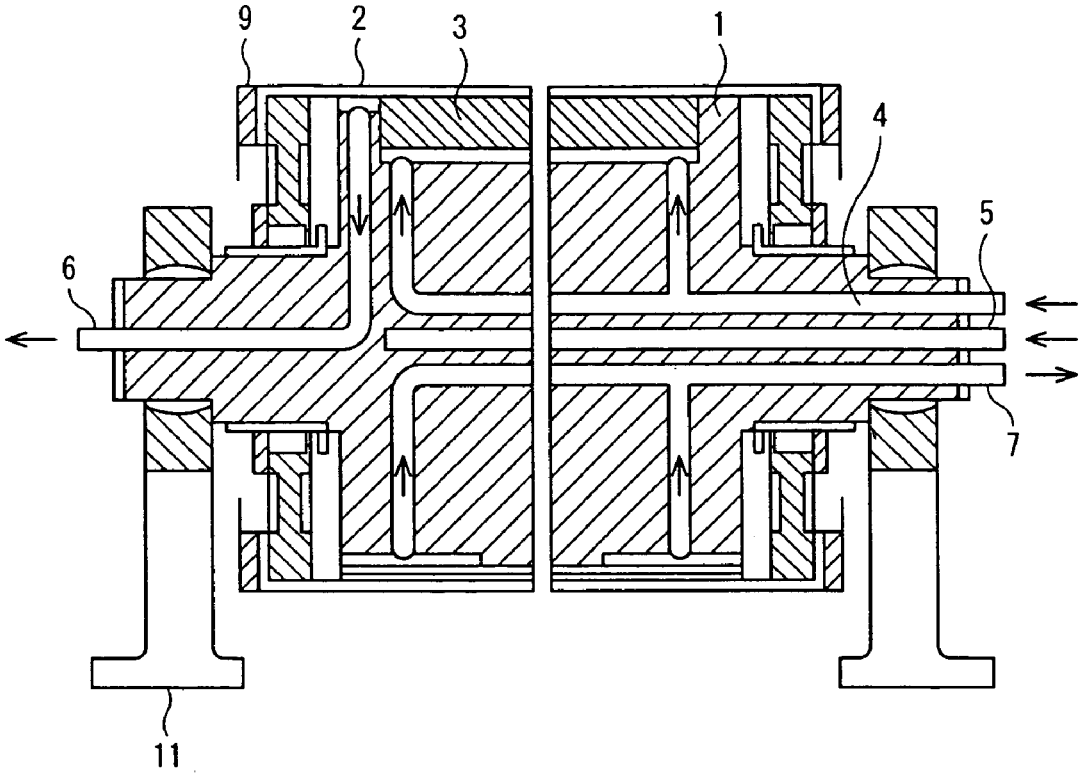
FIG. 14 is a vertical sectional view showing the lower half of the main body of the conventional shoe calender shown in FIG. 13.
Figure 15:
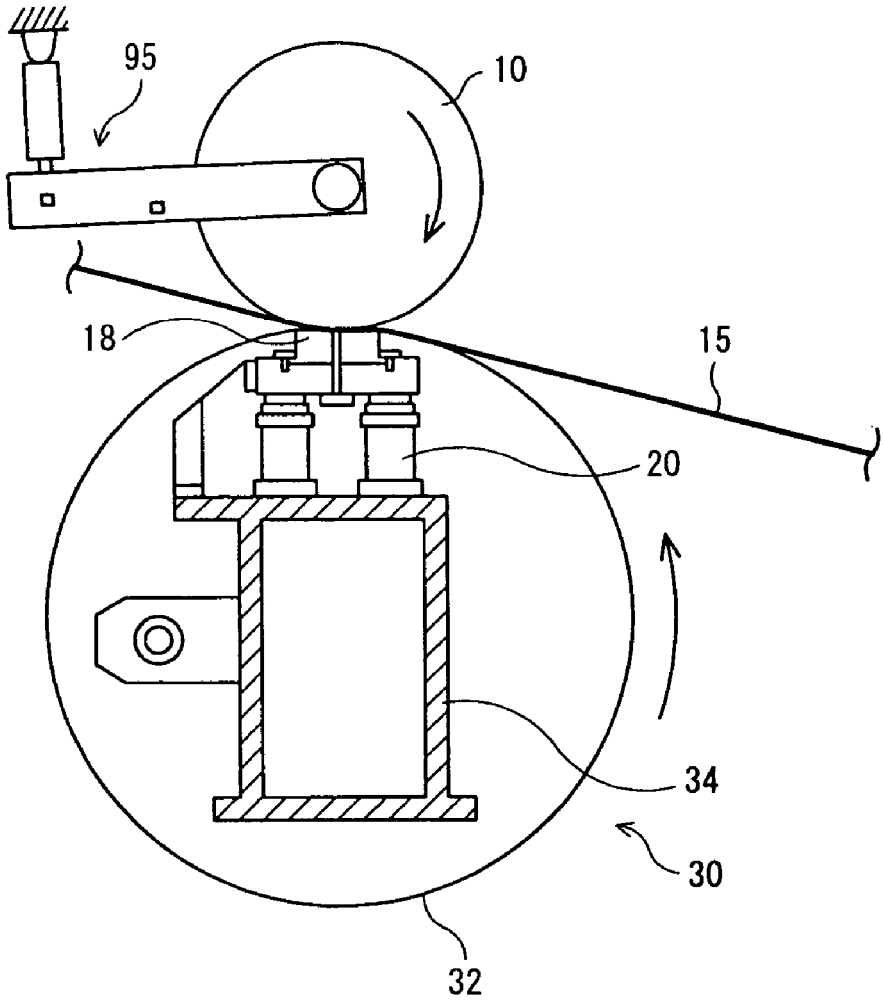
FIG. 15 is across sectional view showing another conventional shoe calender.
Figure 16:
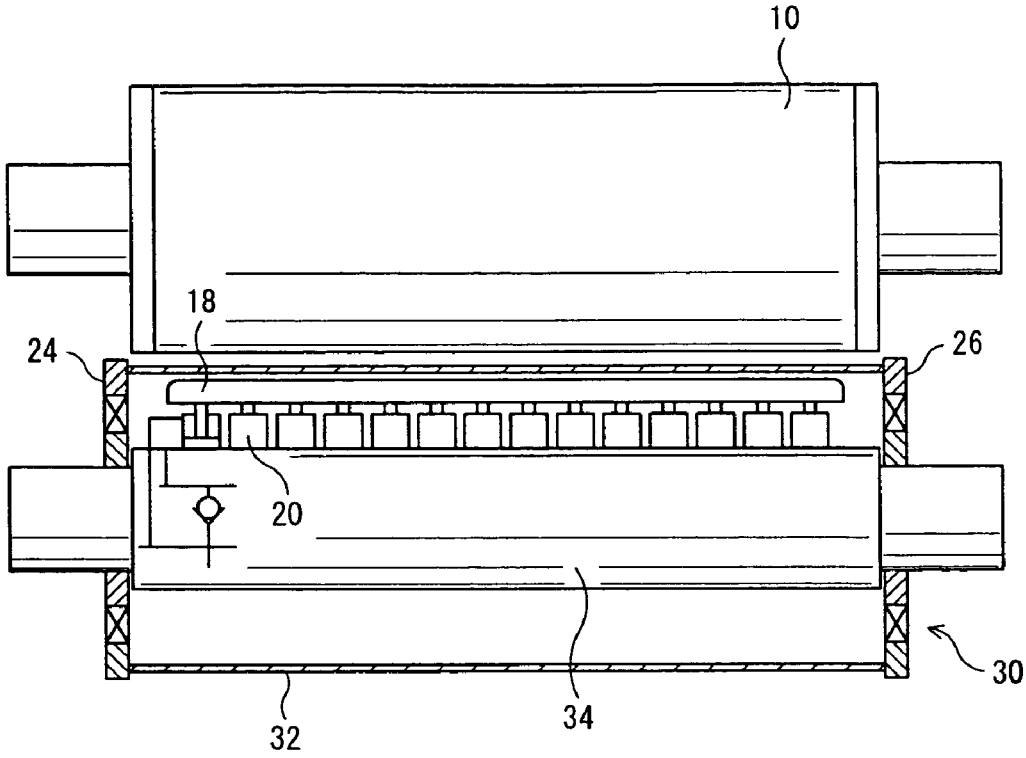
FIG. 16 is a vertical sectional view showing the conventional shoe calender shown in FIG. 15.
Figure 17:
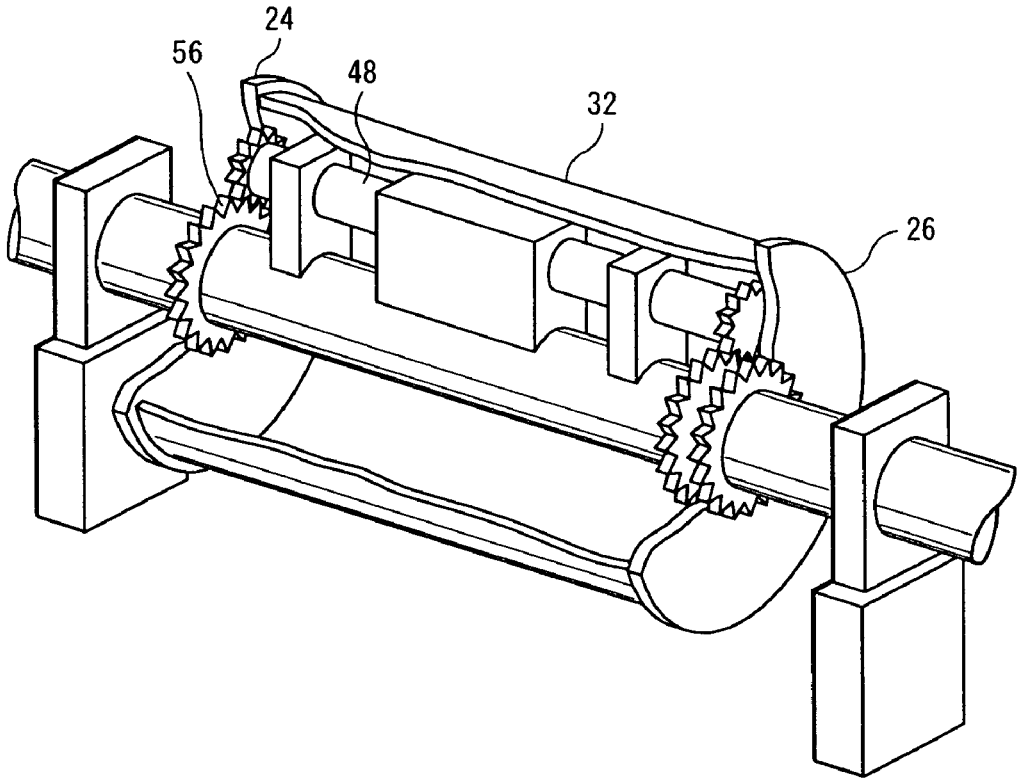
FIG. 17 is a perspective view showing the interior of the shoe roll of the conventional shoe calender shown in FIG. 15.

FIG. 12 shows the support roll of a calender constructed in accordance with the ninth embodiment of the present invention. In the ninth embodiment, the support roll 110 in the above-described seventh embodiment is replaced with a divided type. Since the remaining construction is the same as the seventh embodiment, a description will be given of different parts. Note in FIG. 12 that the same parts as FIG. 10 are represented by the same reference numerals.

In the ninth embodiment, a support roll 110 is constructed of rotatable rolls 115 divided in the axial direction of a pressurizing roll 100.

According to the ninth embodiment, the support roll 110 is constructed of divided rolls 115. Therefore, the area of the support roll 110 that abuts the above-described jacket 101 is reduced. Since the friction resistance that develops by rotation of the jacket 101 is reduced, a load on the driving roll 130 is reduced and therefore the power of the driving motor 150 for rotating the driving roll 130 can be saved.

In FIG. 12, there are shown five support rolls. However, the number of divided rolls is not limited to the 5 support rolls shown in FIG. 12.

While the present invention has been described with reference to the preferred embodiments thereof, the invention is not to be limited to the details given herein, but may be modified within the scope of the invention hereinafter claimed.

What is claimed is:

1. A calender for a sheet of paper comprising:

a metal roll which is rotated by a first driving unit;

a rotatable cylindrical jacket disposed opposite said metal roll to form a calender nip so that the sheet of paper is continuously passed through said calender nip;

a pressurizing shoe, provided within said jacket at the position of said calender nip, for pressing the interior surface of said jacket radially outward to pressurize said calender nip; and a plurality of support members disposed inside said jacket so that they are equally balanced in a peripheral direction of said jacket; wherein one of said support members includes a rotatable roll; and a driving roll arranged at a position opposite to said rotatable roll to press said jacket therebetween, wherein said driving roll is arranged on an outer surface ofsaid-jacket and said driving roll is pressed against said jacket to rotate said jacket; and said rotatable roll comprises a plurality of divided type rolls divided in an axial direction.

2. A calender for a sheet of paper comprising:

a metal roll which is rotated by a first driving unit;

a rotatable cylindrical jacket disposed opposite said metal roll to form a calender nip so that the sheet of paper is continuously passed through said calender nip;

a pressurizing shoe, provided within said jacket at the position of said calender nip, for pressing the interior surface of said jacket radially outward to pressurize said calender nip; and a plurality of support members disposed inside said jacket so that they are equally balanced in a peripheral direction of said jacket; wherein one of said support members includes a rotatable roll; and a driving roll arranged at a position opposite to said rotatable roll to press said jacket therebetween, wherein said driving roll is arranged on an outer surface of said jacket and said driving roll is pressed against said jacket to rotate said jacket; and the outer periphery of said rotatable roll is provided with grooves which extend in the peripheral direction.

3. A calender for a sheet of paper comprising:

a metal roll which is rotated by a first driving unit;

a rotatable cylindrical jacket disposed opposite said metal roll to form a calender nip so that the sheet of paper is continuously passed through said calender nip;

a pressurizing shoe, provided within said jacket at the position of said calender nip, for pressing the interior surface of said jacket radially outward to pressurize said calender nip; and a plurality of support members disposed inside said jacket so that they are equally balanced in a peripheral direction of said jacket; wherein one of said support members includes a rotatable roll; and a driving roll arranged at a position opposite to said rotatable roll to press said jacket therebetween, wherein said driving roll is arranged on an outer surface of said jacket and said driving roll is pressed against said jacket to rotate said jacket; and the outer periphery of said rotatable roll is provided with grooves which extend in spiral form.

4. A calender for a sheet of paper, comprising:

a metal roll which is rotated by a first driving unit;

a rotatable cylindrical jacket disposed opposite to said metal roll to form a calender nip so that the sheet of paper is continuously passed through said calender nip;

a pressurizing shoe, provided within said jacket at the position of said calender nip, for pressing the interior surface of said jacket radially outward to pressurize said calender nip;

a plurality of support members disposed inside said jacket so that they are equally balanced in a peripheral direction of said jacket, at least one of said support members including a support shoe;

a driving roll arranged at a position opposite to said support shoe of said support members to press said jacket therebetween, wherein said driving roll is arranged on an outer surface of said jacket and said driving roll is pressed against said jacket to rotate said jacket;

a roll-moving unit connected to said jacket, said driving roll, and a doctor blade which abuts said jacket, said roll-moving unit for moving said jacket, said driving roll, and said doctor blade between a first position where said jacket is pressed against said metal roll and a second position where said jacket, said driving roll, and said doctor blade are moved away from said metal roll; and a controller for controlling said roll-moving unit and a second driving unit which drives said driving roll;

wherein said controller controls said roll-moving unit so that until speed of said jacket is synchronized with speed of said metal roll, said jacket is held at said second position, controls speed of said second driving unit so that the speed of said jacket is synchronized with the speed of said metal roll, controls said roll-moving unit so that after the speed of said jacket is synchronized with the speed of said metal roll, said jacket is held at said first position, and performs drooping control on said second driving unit after said jacket is held at said first position.

5. The calender as set forth in claim 4, wherein said controller:

controls driving torque of said second driving unit to perform load allotment control with said first driving unit as a master side, after pressurization by said pressurizing shoe is performed at the position of the calender nip; and allots a load on said second driving unit to said first driving unit and gradually reduces the driving torque of said second driving unit to zero, if the load allotment between said first driving unit and said second driving unit is stabilized.

6. The calender as set forth in claim 5, wherein said controller disconnects said driving roll from said jacket after the driving torque of said second driving unit is gradually reduced to zero, and then stops the speed of said second driving unit.

7. A calender for a sheet of paper comprising:

a metal roll which is rotated by a first driving unit;

a rotatable cylindrical jacket disposed opposite said metal roll to form a calender nip so that the sheet of paper is continuously passed through said calender nip;

a pressurizing shoe, provided within said jacket at the position of said calender nip, for pressing the interior surface of said jacket radially outward to pressurize said calender nip; and a plurality of support members disposed inside said jacket so that they are equally balanced in a peripheral direction of said jacket; wherein one of said support members includes a rotatable roll; and a driving roll arranged at a position opposite to said rotatable roll to press said jacket therebetween, wherein said driving roll is arranged on an outer surface of said jacket and said driving roll is pressed against said jacket to rotate said jacket; and said driving roll comprises a plurality of divided type rolls divided in an axial direction.

8. A calender for a sheet of paper comprising:

a metal roll which is rotated by a first driving unit;

a rotatable cylindrical jacket disposed opposite said metal roll to form a calender nip so that the sheet of paper is continuously passed through said calender nip;

a pressurizing shoe, provided within said jacket at the position of said calender nip, for pressing the interior surface of said jacket radially outward to pressurize said calender nip; and a plurality of support members disposed inside said jacket so that they are equally balanced in a peripheral direction of said jacket; wherein a doctor blade arranged at a position opposite to one of said support members, wherein said doctor blade is arranged on an outer surface of said jacket, said doctor blade abutting said jacket; and said doctor blade comprises a plurality of divided type doctor blades divided in an axial direction of said jacket.

9. The calender as set forth in claim 8, wherein said plurality of divided type doctor blades are slidable in the axial direction of said jacket.

* * * * *